United States Patent [19]

Steiger

[11] 4,062,136

[45] Dec. 13, 1977

[54] SCRAPER VEHICLE

[75] Inventor: Douglass W. Steiger, Thief River Falls, Minn.

[73] Assignee: Toreq, Inc., Thief River Falls, Minn.

[21] Appl. No.: 727,269

[22] Filed: Sept. 27, 1976

[51] Int. Cl.[2] ..... E02F 5/00

[52] U.S. Cl. ..... 37/126 AE; 214/82

[58] Field of Search ..... 37/124, 126 R, 126 AE, 37/126 AB, 129 R; 214/82, 29, 44, 300, 307, 310, 83, 22

[56] References Cited

U.S. PATENT DOCUMENTS

| | | | |
|---|---|---|---|
| 1,908,899 | 5/1933 | Kayel | 214/82 X |
| 2,353,120 | 7/1944 | Austin | 37/126 AE |
| 2,934,226 | 4/1960 | Dempster et al. | 214/82 |
| 3,137,400 | 6/1964 | Tapp et al. | 214/82 |
| 3,688,944 | 9/1972 | Gagel | 214/82 X |
| 3,952,432 | 4/1976 | Boersma | 37/126 AE |

FOREIGN PATENT DOCUMENTS

| | | | |
|---|---|---|---|
| 2,505,498 | 2/1975 | Germany | 214/82 |
| 2,135,971 | 2/1973 | Germany | 214/82 |
| 688,250 | 3/1953 | United Kingdom | 37/126 AE |

*Primary Examiner*—E. H. Eickholt

*Attorney, Agent, or Firm*—Williamson, Bains, Moore & Hansen

[57] ABSTRACT

A scraper vehicle includes a body having a longitudinally shiftable apron therein for pushing a load of material from the scraper body. The apron is shifted in a fore-and-aft direction by a pair of hydraulic rams. A retractable and extensible power assist mechanism is connected to the apron and is in a retracted energy storing condition when the apron is in a rearward position. The release of stored energy in the power assist mechanism assists in shifting the apron in a forward or unloading direction.

3 Claims, 4 Drawing Figures

SCRAPER VEHICLE

SUMMARY OF THE INVENTION

Operation of towed type scrapers is dependent on the hydraulic system of the towing vehicle such as tractors. Even though scrapers are presently being constructed in larger sizes, the hydraulic systems in tractors has not been proportionately increased in power. In the larger towed type scraper vehicles, substantial power is needed to shift the scraper apron in a forward direction during unloading of the scraper. Even though some tractors may have sufficient power to tow the large scraper vehicles, the hydraulic system in this tractor is sometimes insufficient to move the scraper apron in a forward unloading direction.

It is therefore an object of this invention to provide a scraper type vehicle with a power assist mechanism which is operative for assisting movement of the apron in a forward unloading direction.

More specifically, it is an object of this invention to provide a scraper type vehicle with an extensible and retractable power assist mechanism which assists movement of the apron in a forward unloading direction and which requires no additional hydraulic power from the tractor. In one embodiment of the invention, a closed fluid pressure ram unit and accumulator is used as the power assist mechanism. In another embodiment of the invention, a helical spring is utilized to impart stored energy to a piston rod for assisting movement of the apron in the forward unloaded direction.

These and other objects and advantages of this invention will more fully appear from the following description made in connection with the accompanying drawings, wherein like reference characters refer to the same or similar parts throughout the several views.

FIGURES OF THE DRAWINGS

PREFERRED EMBODIMENT OF THE INVENTION

Figure 1:
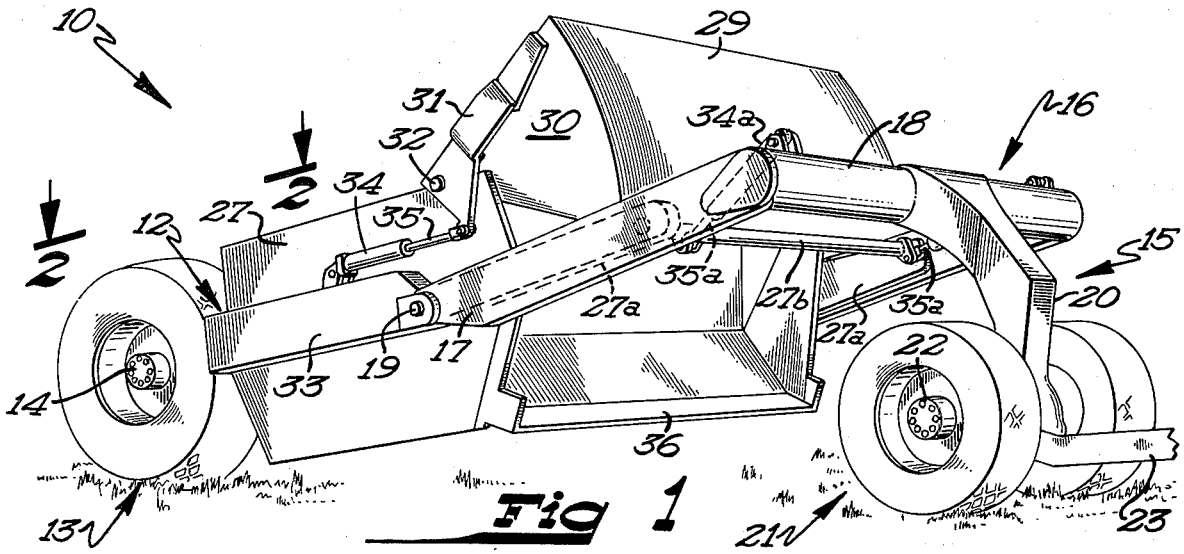
FIG. 1 is a front perspective view of the scraper device embodying the normal power assist mechanism.

Referring now to the drawings and more specifically to FIG. 1, it will be seen that one embodiment of the scraper vehicle, designated generally by the reference numeral 10 is thereshown. The scraper 10 is typically used in farm and industrial operations and includes a body 11 having a generally rectangular shaped rear frame 12 integrally formed therewith and projecting rearwardly therefrom. A pair of rear ground engaging wheels 13 are provided and are interconnected together by an axle 14 journaled in the rear frame 12.

The vehicle 10 is also provided with a front wheel assembly 15 including a U-shaped frame 16 comprised of longitudinal frame elements 17 and a transverse frame element 18. The longitudinal frame element 17 of the U-shaped frame 16 are pivotally connected to the body 11 by pivots 19. A front wheel assembly 15 also includes a vertical frame element 18 which is secured to the mid portion of the transverse frame element 18 and projects forwardly and downwardly therefrom. The front wheel assembly 15 also includes a pair of front wheels 21 whose axle 22 is journaled in the lower end portion of the vertical frame element 20. A draw bar 23 has its rear end secured to the lower end of the vertical frame element 21 and has its forward end connectd to the tractor.

Figure 2:
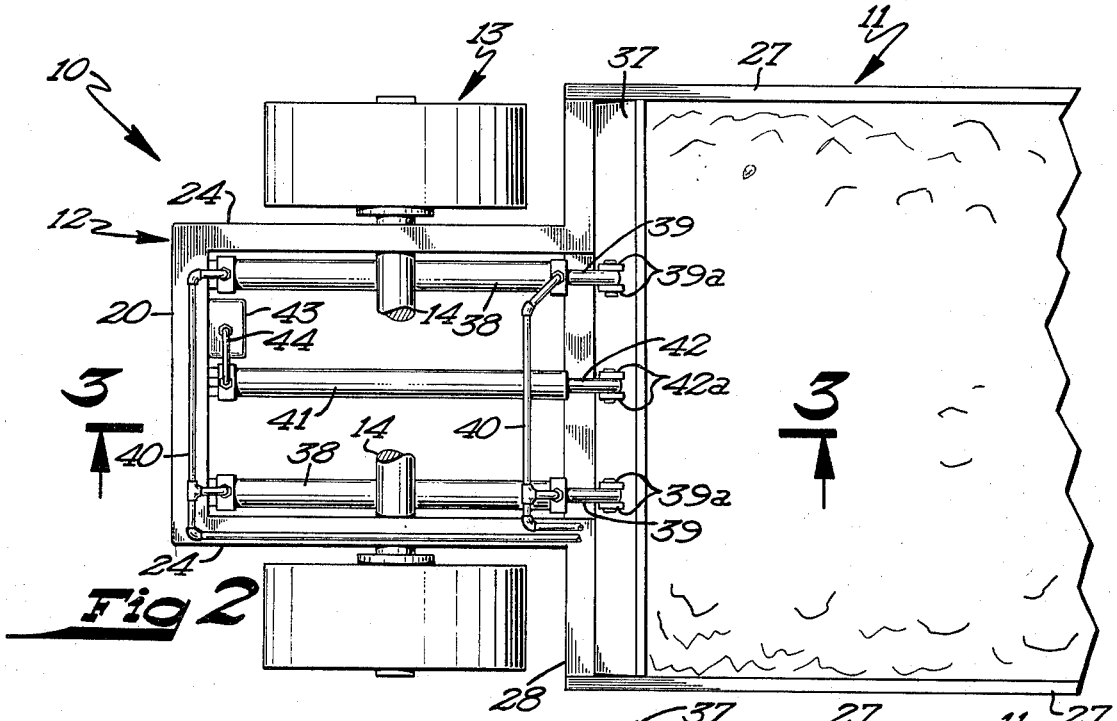
FIG. 2 is a cross-sectional view taken approximately along Line 2—2 of FIG. 1 and looking in the direction of the arrows.
Figure 3:
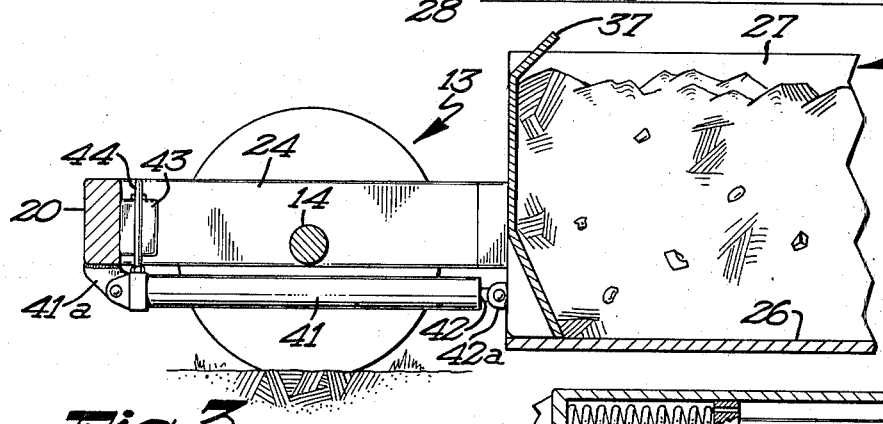
FIG. 3 is a cross-sectional view taken approximately along Line 3—3 of FIG. 2 and looking in the direction of the arrows.

The rear frame 12, as best seen in FIGS. 2 and 3, includes a pair of laterally spaced apart longitudinally rear frame elements 24, each of which is rigidly secured at its front end to the scraper body 11. A transverse rear frame element 25 extends between and is rigidly secured to the rear ends of the longitudinal rear frame elements 24.

The vehicle body 11 includes a lower wall floor 26, substantially parallel upstanding side walls 27, and a rear wall 28. The open front end of the scraper body 11 is provided with a closure type gate or scoop 29 having end walls 30 to which are secured rigid arms 31. The arms 31 are pivotally connected by pivots 32 to the side walls 27 of the vehicle body adjacent the front end portion of the latter. With this arrangement, the gate 29 is swingable between an upper or open position as shown in FIG. 1 to a lowered closed position.

Means are provided for shifting the gate 29 between its upper and lower positions, and this means includes a pair of double acting hydraulic cylinders 34 which are mounted on longitudinally extending rigid frame members 33 secured to the side walls 27. The hydraulic cylinders 34 are provided with pistons which are moveable therein and each of which is connected to a piston rod 35 which in turn is connected to one of the arms 31. It will therefore be seen that extension and retraction of the piston rods 35 cause the gate 29 to be swung between the upper and lowered positions.

The lower front edge portion of the scraper body floor 26 extends downwardly and forwardly and actually defines a cutting edge bar 36 which serves to scrape or scarify soil or other material into the body 11 when the scraper vehicle is moved in a forwardly direction and when the gate 29 is in a raised position. Means are also provided for unloading a load of soil or other material from the vehicle body and this means includes the conventional vertically disposed substantially flat apron 37 which is positioned within the body 11 and which extends transversely between the sidewalls thereof. The apron 37 is shiftable in the body 11 in a fore-and-aft direction between a rearward position, as shown in FIGS. 2 and 3, and a forward position as shown in FIG. 1. When the apron 37 is shifted from the rear position in a forward direction, material may be unloaded from the scraper body if the gate 29 is in an elevated position.

Means are provided for shifting the apron 37 in a fore-and-aft direction, and this means includes a pair of double acting hydraulic cylinders 38 each being mounted on the transversed rear frame element 25. Each cylinder 39 has a piston therein which in turn is connected to a piston rod 39, the latter being secured to ears 39*a* affixed to the apron 37. It will therefore be seen that when the piston rods 39 are extended, the apron 37 will be urged in a forward unloading direction to urge the material from the scraper body. Conversely, when the piston rods 39 are retracted, the apron 37 will be retracted. Suitable hydraulic lines 40 interconnect the double acting cylinders to the hydraulic system of the tractor.

A power assist mechanism is also provided for imparting and assisting movement of the apron in a forward direction. In the preferred embodiment, this means includes a cylinder 41 which is secured at its rear end to the transverse frame element 25. The cylinder 41 has a piston moveable therein which in turn is connected to a piston rod 42, the latter being secured to ears 42a affixed to the apron 37. An accumulator tank 43 is also mounted on the transverse rear frame element 25 adjacent the cylinder 41, the latter being connected in communicating relation to the accumulator tank by a conduit 44. It will be noted that the conduit 44 intercommunicates the accumulator tank with the cylinder 44 rearwardly of the piston disposed within the cylinder 41. The piston and the accumulator contains a compressable gas such as nitrogen whereby when the piston rod 42 is in the retracted position, the gas will be compressed thereby storing energy within the power assist mechanism which will be released when the apron 37 is shifted forwardly.

In operation, the scraper body will be loaded with a load of material such as soil or the like, the scraper being towed behind a conventional tractor. In the soil loading or scarifying operation, the body will be shifted to its lowered operating position so that the cutting edge 36 will penetrate the surface of the ground. It is pointed out that the body 11 is shiftable between an elevated transport position and a lowered operating position by double acting hydraulic cylinders **34*a* which are mounted on the transverse frame element 18 adjacent opposite ends thereof. Each of these double acting hydraulic cylinders 34*a* are provided with suitable pistons that are moveable therein, each piston being connected to a suitable piston rod 35*a* which in turn is connected to a transverse frame element 27*b* which extends between and is rigidly connected to a pair of arms 27*a* projecting forwardly from the side walls 27 of the body 11. Extension and retraction of the piston rods 35*a*** raise and lower the body between operating and transport positions in a well-known manner.

During the loading operation, the apron 37 will be in a rearward position thereby permitting the interior of the body to be filled with dirt. When it is desirable to unload the scraper vehicle, the gate 29 will be elevated and the piston rods 39 will be shifted forwardly to shift the apron in a forward direction. Since the power shift mechanism is in a retracted position, forward movement of the apron will release the stored energy in the form of compressed gas so that the stored energy is imparted to the apron 37 through the piston rod 42 to assist movement thereof in a forward direction. Thus the power assist mechanism permits the use of large scrapers with more moderate sized tractor vehicles even though the hydraulic system of the tractor may be insufficient to permit effective unloading of the scraper body.

Figure 4:
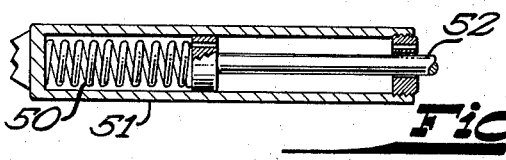
FIG. 4 is a fragmentary cross-sectional view of a modified form of the invention.

Referring now to FIG. 4, it will be seen that a modified form of the power assist mechanism is thereshown and also includes a cylinder 51 which is secured to the transverse rear frame member 20 which projects forwardly therefrom. The cylinder 51 is provided with a piston **51*a* which is moveable therein and which is connected to a piston rod which projects forwardly of the cylinder. The piston rod 52 is also connected to the apron 37 and is extensible and retractable with respect to the cylinder 51. A helical spring 50 is positioned within the cylinder 51 and is interposed between the rear wall thereof and the piston 51*a*. It will therefore be seen that when the piston rod 52 is in a retracted position, the spring 50 will be compressed thereby storing energy when the apron is in the rearward position. Thereafter, when the apron is shifted forwardly by the double acting hydraulic cylinders, the stored energy of the compressed spring 50 will be released and transmitted to the apron 37 through the piston rod 52** to assist forward movement of the apron during the unloading operation.

From the foregoing dscription, it will be seen that I have provided a conventional scraper vehicle with a power assist mechanism, which is not only of simple and inexpensive construction and operation, but one which functions in a more efficient manner than any heretofore known comparable device.

What is claimed is:

1. A scraper type vehicle comprising a body including side walls, a bottom wall, and an open front end, the bottom wall having a leading transverse edge defining a digging edge, a gate swingably mounted on said body for swinging movement between a closed position obstructing the open front end, and an open position wherein the gate is swung to a nonobstructing position with respect to the open front end of the body, means for shifting the gate between open and closed positions, a pair of rear ground engaging wheels and a front ground engaging wheel assembly for supporting the body for travel over the surface of the ground, a vertical apron positioned within said body extending transversely thereof and being shiftable longitudinally of said body between a retracted rearward position adjacent the rear end thereof and a forward position adjacent the front end of said body to progressively urge material within the body outwardly of the open front end, power means mounted on said body and engaging said apron to shift the latter between rearward and forward positions, and an extensible and retractable power assist mechanism mounted including a cylinder on said body and having a piston moveable therein, a piston rod secured to said piston and connected with said apron, said piston rod being extensbile and retractable relative to said cylinder, a helical spring in said cylinder engaging said piston to normally urge the piston rod in a direction to input energy to said apron, said piston rod being in a retracted energy storing condition when the apron is in its rearward position and being in an extended position when the apron is in the completely forward position, said piston rod transmitting the stored energy in the helical spring to said apron when the latter is urged forwardly by said power means to thereby assist forward movement of the apron in a forward direction.

2. A scraper type vehicle comprising a body including side walls, a bottom wall, and an open front end, the bottom wall having a leading transverse edge defining a digging edge, a gate swingably mounted on said body for swinging movement between a closed position obstructing the open front end, and an open position wherein the gate is swung to a nonobstructing position with respect to the open front end of the body, means for shifting the gate between open and closed positons, a pair of rear ground engaging wheels and a front ground engaging wheel assembly for supporting the body for travel over the surface of the ground, a vertical apron positioned within said body extending transversely thereof and being shiftable longitudinally of said body between a retracted rearward position adjacent the rear end thereof and a forward position adjacent the front end of said body to progressively urge material within the body outwardly of the open front end, power means mounted on said body and engaging said apron to shift the latter between rearward and forward positions, and an extensible and retractable power assist mechanism including a cylinder mounted on said body and having a piston moveable therein, a piston rod secured to said piston and connected with said apron, said piston rod being extensible and retractable relative to said cylinder, an accumulation tank mounted on said body and being connected to said cylinder in communicating relation therewith, and a compressible fluid on said cylinder and accumulation tank,

3. The scraper vehicle as defined in claim 2 wherein said fluid comprises a gas.

* * * * *